US005821908A

United States Patent [19]

Sreenivas

[11] Patent Number: 5,821,908

[45] Date of Patent: Oct. 13, 1998

[54] SPHERICAL LENS ANTENNA HAVING AN ELECTRONICALLY STEERABLE BEAM

[75] Inventor: Ajay I. Sreenivas, Niwot, Colo.

[73] Assignee: Ball Aerospace and Technologies Corp., Broomfield, Colo.

[21] Appl. No.: 620,292

[22] Filed: Mar. 22, 1996

[51] Int. Cl.[6] ..... H01Q 15/08

[52] U.S. Cl. ..... 343/911 R; 343/911 L; 343/753; 343/754

[58] Field of Search ..... 343/911 R, 909, 343/911 L, 753, 754, 853; 342/372; H01Q 15/08

[56] References Cited

U.S. PATENT DOCUMENTS 3,255,457 6/1966 Hannan ..... 343/911 R
3,404,405 10/1968 Young, Jr. ..... 343/911 R
4,268,831 5/1981 Valentino et al. ..... 343/754
4,825,216 4/1989 DuFort ..... 342/376

*Primary Examiner*—Hoanganh T. Le
*Attorney, Agent, or Firm*—Sheridan Ross P.C.

[57] ABSTRACT

The invention relates to an antenna system which is capable of producing multiple, high-gain, independently steerable antenna beams from a single antenna aperture. The system accomplishes this, in part, by utilizing a separate phased array antenna as the feed element of a spherical lens for each desired beam. In this fashion, the beam(s) produced by the antenna system can each be electronically steered (independently of the other beams, if any) and physical movement of the feed element(s) is not required. The invention may also use multiple spherical lenses, wherein each lens includes at least one phased array feed.

29 Claims, 9 Drawing Sheets

SPHERICAL LENS ANTENNA HAVING AN ELECTRONICALLY STEERABLE BEAM

FIELD OF THE INVENTION

The invention relates in general to antenna systems using spherical lenses and, more particularly, to an antenna system using a spherical lens in conjunction with an electronically steerable beam.

BACKGROUND OF THE INVENTION

A communications satellite is an artificial satellite put into orbit around the earth to facilitate communications on earth. Communications satellites normally include antenna systems and receiver and transmitter circuitry capable of receiving a signal from a first location on earth and transmitting the signal to a second location on earth. Satellite communications systems are currently being proposed which will be capable of providing continuous global communications coverage. Such systems will be comprised of a multitude of satellites which continuously orbit the earth, wherein each satellite is capable of providing communications coverage over a portion of the earth's surface.

To provide coverage over a portion of the earth's surface, it is desirable that a satellite include an antenna system capable of creating multiple high-gain beams simultaneously. It is also desirable that each of the beams be independently steerable. Because power is a limited resource in space (normally derived from solar radiation through the use of solar cells), it is important that the antenna system on the satellite operate as efficiently as possible to minimize power consumption. Therefore, power losses in the antenna system should be kept relatively low. Lastly, the antenna system used by the satellite should be compact and lightweight as physical space and payload on the satellite are limited.

One method of creating multiple simultaneous beams involves the use of a conventional phased array antenna. Using a phased array antenna to create multiple beams, however, requires the design and implementation of a highly complex beamforming network. A beamforming network of this type is very difficult to design, very costly to build, and is very lossy in operation. These beamforming networks generally include a plurality of divider/combiner units which are interconnected in a predetermined configuration to provide feed signals to a plurality of antenna elements. The divider/combiner units and their associated interconnections normally add a relatively large amount of signal loss to the antenna system. In addition to this signal loss, phased array antennas also produce a scan loss whenever an antenna beam is pointing in a direction other than normal to the array face. These losses result in inefficient antenna operation.

Another method of creating multiple simultaneous beams involves the use of a spherical lens. A number of waveguide horns are located around the periphery of the spherical lens in the focal surface of the lens. The spherical lens collimates the signals from the horns to produce a number of high gain beams at the opposite side of the lens. An antenna system of this type does not require a complex beamforming network and produces multiple beams each having substantially identical gain characteristics. However, because the feeds are closely packed around the periphery of the lens, independent steering of the beams is limited as this steering can only be accomplished by physically moving the individual feeds in the focal surface.

SUMMARY OF THE INVENTION

The present invention relates to an antenna system which is capable of producing multiple, high-gain, independently steerable antenna beams from a single antenna aperture. The system accomplishes this, in part, by utilizing a separate phased array antenna as the feed element of a spherical lens for each desired beam. In this fashion, the beam(s) produced by the antenna system can be electronically steered and physical movement of the feed element(s) is not required. The invention has application in satellite communications systems as well as any other application where a plurality of steerable beams is required. The system of the present invention may be produced as a relatively compact, lightweight unit which is capable of low loss operation.

The antenna system of the present invention includes a collimating lens and at least one phased array antenna feed. The phased array antenna feed is capable of creating a primary beam which is delivered to the focal surface of the collimating lens such that the lens collimates the primary beam to produce a relatively narrow secondary beam on the other side of the lens. This secondary beam may be steered by adjusting the phase characteristics of the phased array antenna such that the location of the primary beam on the focal surface of the lens is changed. These adjustments can be accomplished electronically and, therefore, beam steering can be implemented without physical movement of the feed or the lens.

In one aspect of the present invention, an antenna system is provided having a lens capable of collimating a beam focused on a focal surface adjacent to the lens and at least one phased array antenna unit having a plurality of antenna elements. In addition, the antenna system also includes means for focusing a primary beam from the at least one phased array antenna unit on the focal surface of the lens. The focal surface of the lens may be near the physical surface of the lens or it may be coincident with the surface. The lens may include, for example, a spherical lens such as a Luneberg lens, a constant-K lens, or a spherical shell lens.

The phased array antenna unit is capable of creating a steerable primary beam for delivery to the focusing means. The primary beam may be a transmit beam, a receive beam, or both. To create the primary beam, selected elements in the array may have a transmitter and/or receiver means associated therewith. This primary beam is ultimately collimated in the lens and emitted from the antenna system in a relatively high gain secondary beam.

The elements of each phased array antenna unit are arranged in an array configuration in fixed relation to one another. The elements in the array may include any type of commonly available electromagnetic radiating element, such as a dipole, a waveguide horn, a circular waveguide radiator, a helical antenna, a microstrip patch antenna, and others.

Each phased array antenna unit also includes phasing means associated with at least some of the elements in the array for use in steering the primary transmit and/or receive beam(s). The phasing means is capable of individually adjusting the phase of each of the elements with which it is associated. The phasing means may include, for example, a digital switching means for switching any one of a number of different lengths of transmission line into the signal flow path of each element, a ferrite phase shifter, a diode phase shifter, or an electromechanical phase shifter.

As described above, the focusing means is operative for focusing the primary beam from the phased array antenna on the focal surface of the lens. The focusing means may also be capable of receiving a beam focused on the focal surface by the lens and transferring this beam to the phased array antenna. The focusing means may include any device capable of receiving an electromagnetic beam and focusing that beam to substantially a point on a predetermined surface. Examples of such devices include dielectric lenses and waveguide lenses. It is necessary to focus the primary beam on the focal surface of the lens so that the primary beam can be properly collimated by the lens.

To create more than one steerable beam, a plurality of phased array antenna units is used. These phased array antenna units are positioned around the periphery of the lens, each having a focusing means associated with it. In this fashion, each beam produced by the antenna system can be steered independently of the other beams produced by the system without physically moving the associated feeds. In addition, all of the beams may be produced simultaneously.

In another aspect of the present invention, a multiple beam antenna system is provided. The system includes a plurality of spherical lenses each having at least one phased array antenna feed. The phased array antenna feeds may be of the type described above. The system may also include focusing means between each phased array feed and its associated spherical lens for focusing a primary beam from the phased array onto the focal surface of the spherical lens.

Each phased array antenna feed is capable of producing an independently steerable primary beam which may be a transmit beam or a receive beam. Each primary beam is collimated in an associated spherical lens to create a secondary beam. Therefore, the system is capable of creating multiple, independently steerable secondary beams simultaneously. The plurality of spherical lenses are preferably held in fixed relation to one another using a support means. If there is more than one phased array feed associated with each spherical lens, it is preferable that the feeds be held in fixed relation to one another around the periphery of the spherical lens (although in one embodiment they may be moveable with respect to one another to provide further steerability). The phased array feeds associated with a single spherical lens may be arranged in rows and columns or any other configuration which can produce a desired group of secondary beams. The system may be used in a satellite communications system to provide ground coverage over a predetermined portion of the earth's surface.

DETAILED DESCRIPTION

The present invention relates to an antenna system which is capable of producing multiple, high-gain, independently steerable antenna beams from a single antenna aperture. The system accomplishes this, in part, by utilizing a separate phased array antenna as the feed element of a spherical lens for each desired beam. In this fashion, the beam(s) produced by the antenna system can be electronically steered and physical movement of the feed elements is not required. The invention has application in satellite communications systems as well as any other application where a plurality of steerable beams is required. The system of the present invention may be produced as a relatively compact, lightweight unit which is capable of low loss operation.

Figure 1:
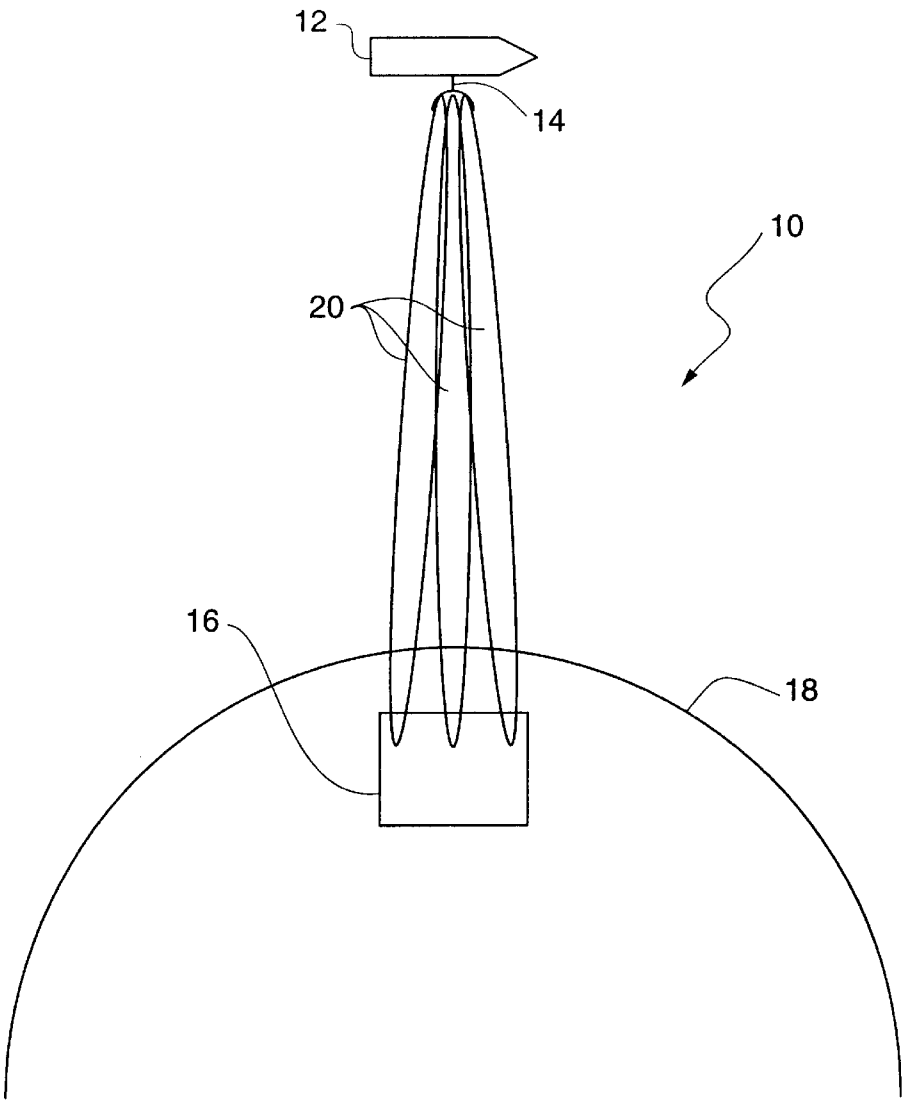
FIG. 1 is a diagram illustrating a satellite communications system which may utilize the antenna system of the present invention.

FIG. 1 illustrates a typical satellite communications system 10 in which the antenna system of the present invention may be employed. The communications system includes a satellite 12 having an antenna system 14 for receiving communication signals from and transmitting communications signals to a predetermined area 16 on the surface of the earth 18. As illustrated in FIG. 1, the antenna system 14 is capable of producing a plurality of beams 20 simultaneously. This plurality of beams 20 may represent a number of different communication channels which are open at the same time for carrying such things as telephone conversations and/or television transmissions.

Figure 2:
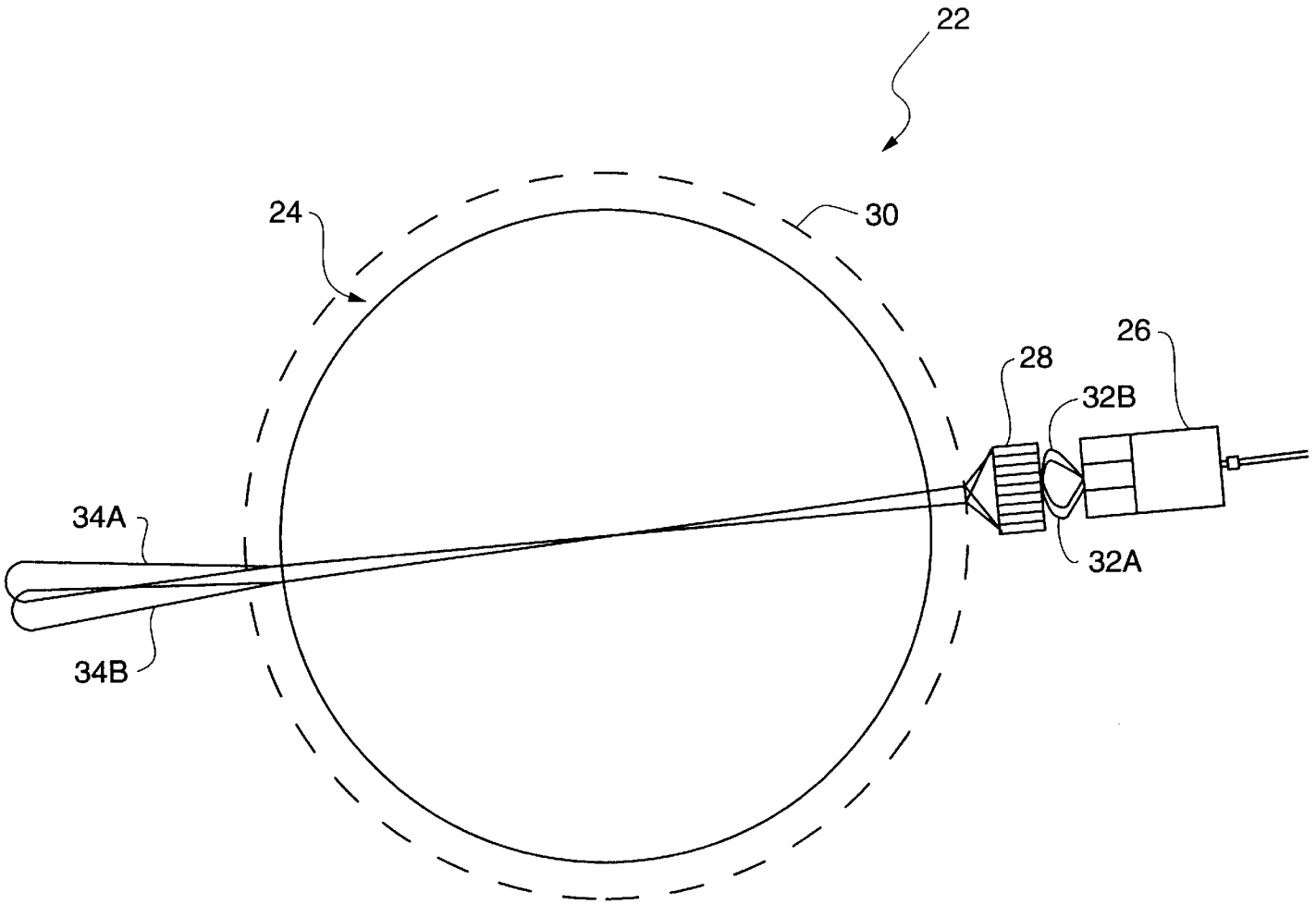
FIG. 2 is a side view illustrating one embodiment of the antenna system of the present invention.

FIG. 2 is a side view of an antenna system 22 in accordance with the present invention. The system 22 is capable of operating in a transmit mode, where a beam of electromagnetic energy is radiated to an external receiver, and/or in a receive mode, where electromagnetic energy is received from an external source. As illustrated, system 22 includes a spherical lens 24 having a focal surface 30, a phased array antenna 26, and a waveguide lens 28. In transmit mode, the phased array antenna 26 illuminates the waveguide lens 28 with a beam of electromagnetic energy which the waveguide lens 28 focusses on the focal surface 30 of the spherical lens 24 to create a relatively high-gain beam of electromagnetic energy on the opposite side of the spherical lens 24. In the receive mode, the spherical lens 24 receives a wave of electromagnetic energy having a substantially planar wavefront and focusses the wave on the focal surface 30 of the spherical lens 24. The wave is then picked up by the waveguide lens 28 which delivers the wave to the phased array antenna 26.

As is apparent from the above description, in transmit mode, the spherical lens 24 is operative for collimating a beam of electromagnetic energy focussed on the focal surface 30 on one side of the lens 24 to produce a high gain beam of electromagnetic energy on an opposite side of the lens. In receive mode, the spherical lens 24 is operative for receiving an electromagnetic signal having a substantially planar wavefront from one side of the lens and focussing that signal on the focal surface 30 on an opposite side of the lens 24. The spherical lens may comprise a Luneberg lens, a constant-K lens, or a spherical shell lens, all of which are well known in the art and hence will not be described further. It should be appreciated that the term "spherical lens", as used herein, refers to any lens for which a substantial portion of the outer surface is spherical in shape and is not limited to lenses having a fully spherical outer surface.

As described above, the waveguide lens 28 acts as an intermediary focusing device between the phased array antenna 26 and the spherical lens antenna 24. The waveguide lens 28 is comprised of a plurality of waveguide sections of varying lengths arranged in an array configuration. The lengths of the waveguide sections are chosen to achieve the refractive properties required to focus the primary beam received from the phased array antenna onto the focal surface of the spherical lens antenna. Also, other properties of the waveguide sections may be adjusted to achieve the desired refractive properties, such as the type of dielectric material filling the waveguide sections and the dimensions of the sections. As an alternative to a waveguide lens, other means for focusing a beam of electromagnetic energy may also be used in conjunction with the present invention. For example, a dielectric lens may be utilized. With a dielectric lens, both the shape of the lens and the type of dielectric material are chosen to achieve the desired refractive properties. Regardless ofthe type used, the focusing means should have an aperture large enough to capture a substantial portion of the primary beam from the phased array antenna over the full range of movement of the primary beam. This ensures efficient and uniform operation over the full scanning range of the secondary beam with minimal scan loss.

The phased array antenna 26 is operative for creating a steerable primary beam. The primary beam may be either a transmit beam or a receive beam. Because of the reciprocal nature of antennas, the transmit beam and the receive beam of the phased array antenna will be identical in shape in any given direction. The phased array antenna of the present invention includes a plurality of radiating elements arranged in fixed relation to one another. Almost any type of radiating element may be utilized. In one embodiment of the present invention, seven open-end circular waveguides are used as the radiating elements for the phased array antenna.

Each element of the phased array antenna 26 has a phase adjustment means associated with it for adjusting the phase of a signal being transmitted or received by that element. By varying the relative phase between elements in the array, a primary beam, and ultimately a secondary beam, can be "steered" through a range of radiation angles. For example, FIG. 2 illustrates a primary beam 32A created by phased array antenna 26. Primary beam 32A is directed through spherical lens 24 to create secondary beam 34A. The relative phase between elements in the array 26 can now be adjusted so that primary beam 32B results. Primary beam 32B is directed through spherical lens 24 to create secondary beam 34B. Therefore, by varying the phase relationships between elements of the phased array antenna, it is possible to steer the secondary beam on the other side of the spherical lens antenna 24. The varying of phase can be accomplished by a separate beamsteering computer.

Figure 3A:
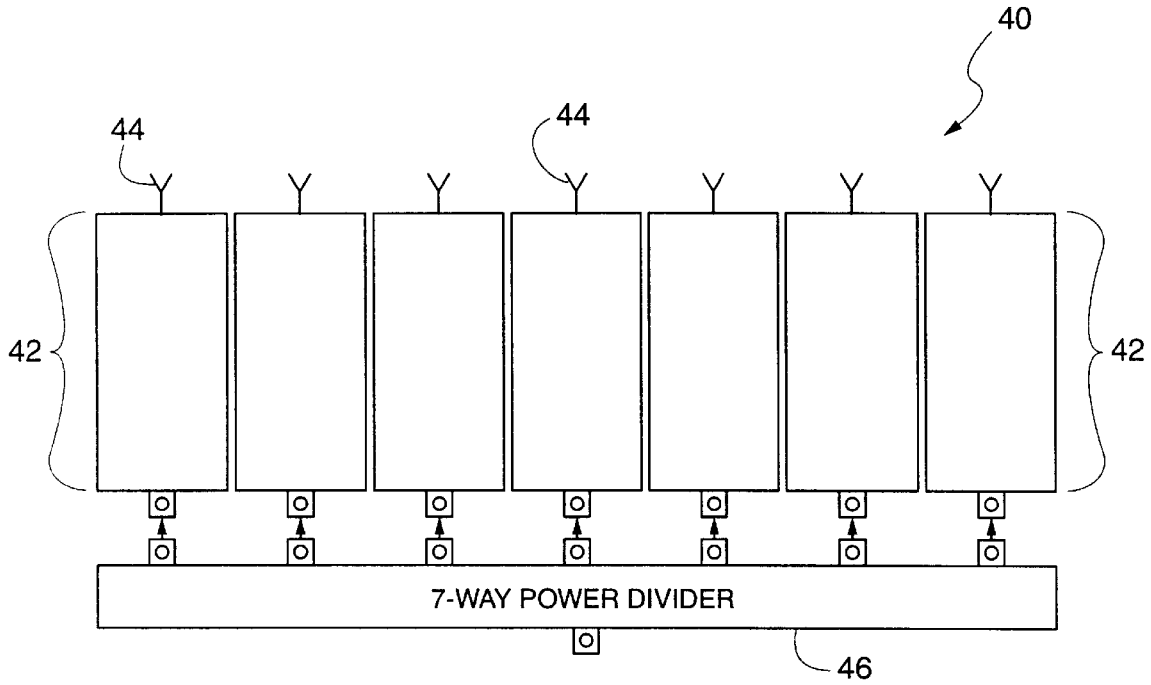
FIGS. 3A and 3B illustrate a phased array antenna transmit system which may be used in accordance with the present invention.

The phased array antenna of the present invention may be an active or a passive array. In other words, the array may include separate transmitter and/or receiver means at each element or a single means for the entire array. FIG. 3A is a schematic diagram illustrating one embodiment of an active phased array transmitter system 40 which may be utilized in accordance with the present invention. The system 40 includes: a plurality of separate transmitter modules 42, each module feeding a separate radiating element 44, and a power dividing means 46 for distributing a single input signal to the plurality of modules 42. Each module in the plurality 42 may apply amplification and/or phase shift to the signal received from the power dividing means 46 to achieve a desired antenna pattern.

Figure 3B:
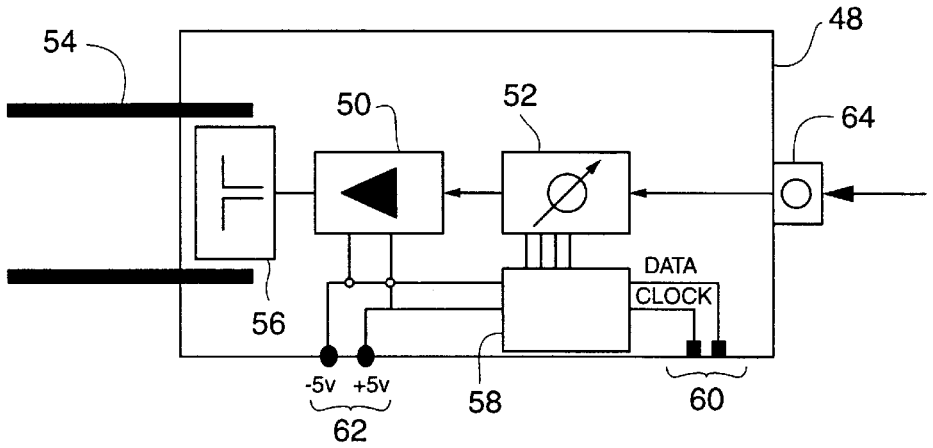

FIG. 3B illustrates one embodiment of a transmitter module 48 which may be used in the system 40 of FIG. 3A. As illustrated, the transmitter module 48 may include: amplification means 50, digital phase shifter means 52, circular waveguide radiator 54 including waveguide transition 56, phase shifter control unit 58, control signal inputs 60, dc power inputs 62, and signal input 64. The signal from divider 46 is received through signal input 64 and delivered to digital phase shifter 52. Digital phase shifter 52 shifts the phase of the signal according to a digital input signal from phase shifter control unit 58. Control unit 58 creates the digital input signal in response to a control signal received from a beamsteering computer (not shown), or similar system computer, through control signal inputs 60. After phase shifting, the signal is delivered to amplification means 50 which amplifies the signal by a predetermined gain factor. In an alternative embodiment, the gain factor of the amplification means 50 may be adjustable under the control of a system computer to provide further beamshaping capabilities. After amplification, the signal is delivered to the waveguide transition 56 which launches the signal into the circular waveguide radiating element 54. The signal is then transmitted from the open end of the element 54 and eventually combines in space with the signals transmitted from each of the other elements in the array to form the primary transmit beam of the phased array antenna.

Figure 4A:
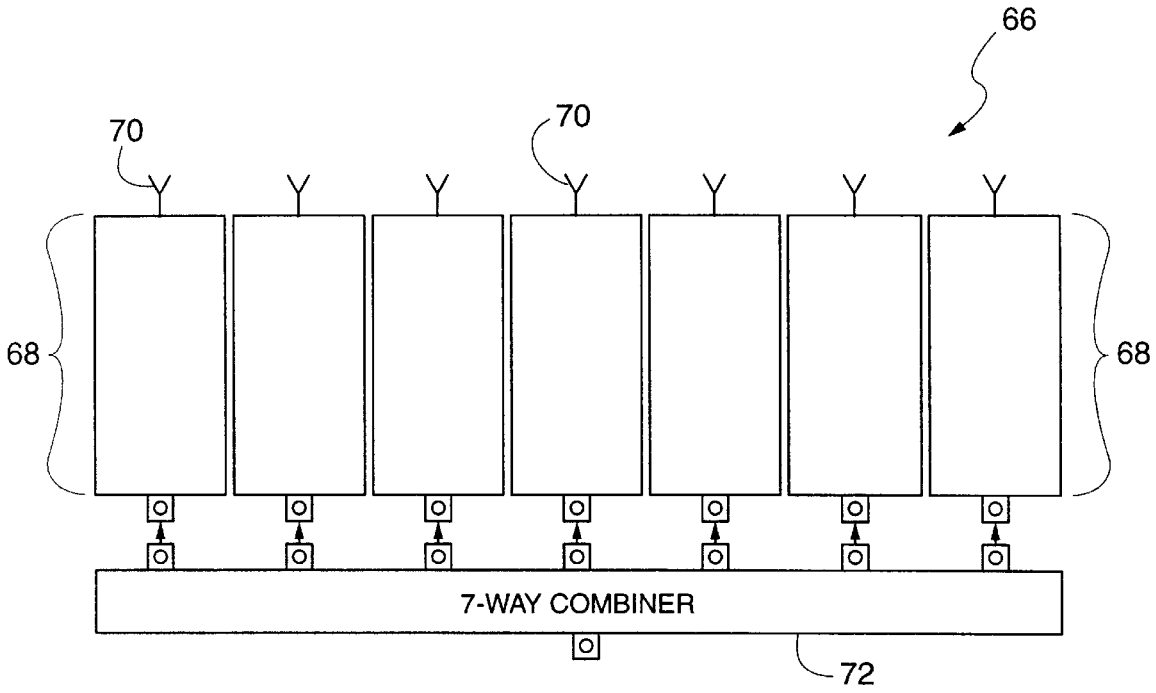
FIG. 4A and 4B illustrate a phased array antenna receive system which may be used in accordance with the present invention.

FIG. 4A is a schematic diagram illustrating an active phased array receiver system 66 which may be used in accordance with the present invention. The receiver system 66 includes: a plurality of receiver modules 68, each module receiving a signal from a separate antenna element 70, and a combining means 72 for combining output signals from each of the plurality of receiver modules 68. Each of the modules in the plurality 68 may apply low noise amplification and/or phase shift to the signal received by the corresponding element 70 before signal combination.

Figure 4B:
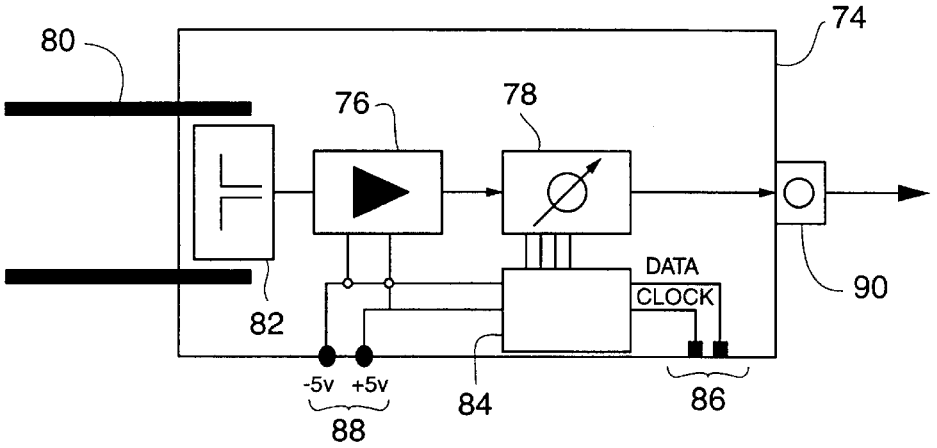

FIG. 4B illustrates one embodiment of a receiver module 74 which may be used in the system 66 of FIG. 4A. The module 74 includes: low noise amplifier 76, phase shifter 78, circular waveguide radiator 80 including waveguide transition 82, phase shifter control unit 84, control inputs 86, dc power inputs 88, and signal output port 90. The receiver module 74 basically operates in the reverse of transmitter module 48 of FIG. 3B and, therefore, further operational description of the module 74 will not be undertaken.

It should be appreciated that other phased array antenna configurations may be used in accordance with the present invention and the configurations described above are not meant to be limiting. For example, passive arrays and/or non-modularized feed structures may be utilized. In addition, transmit/receive modules may be used which include both transmitter and receiver circuitry in each module with duplexing means therebetween.

Figure 5:
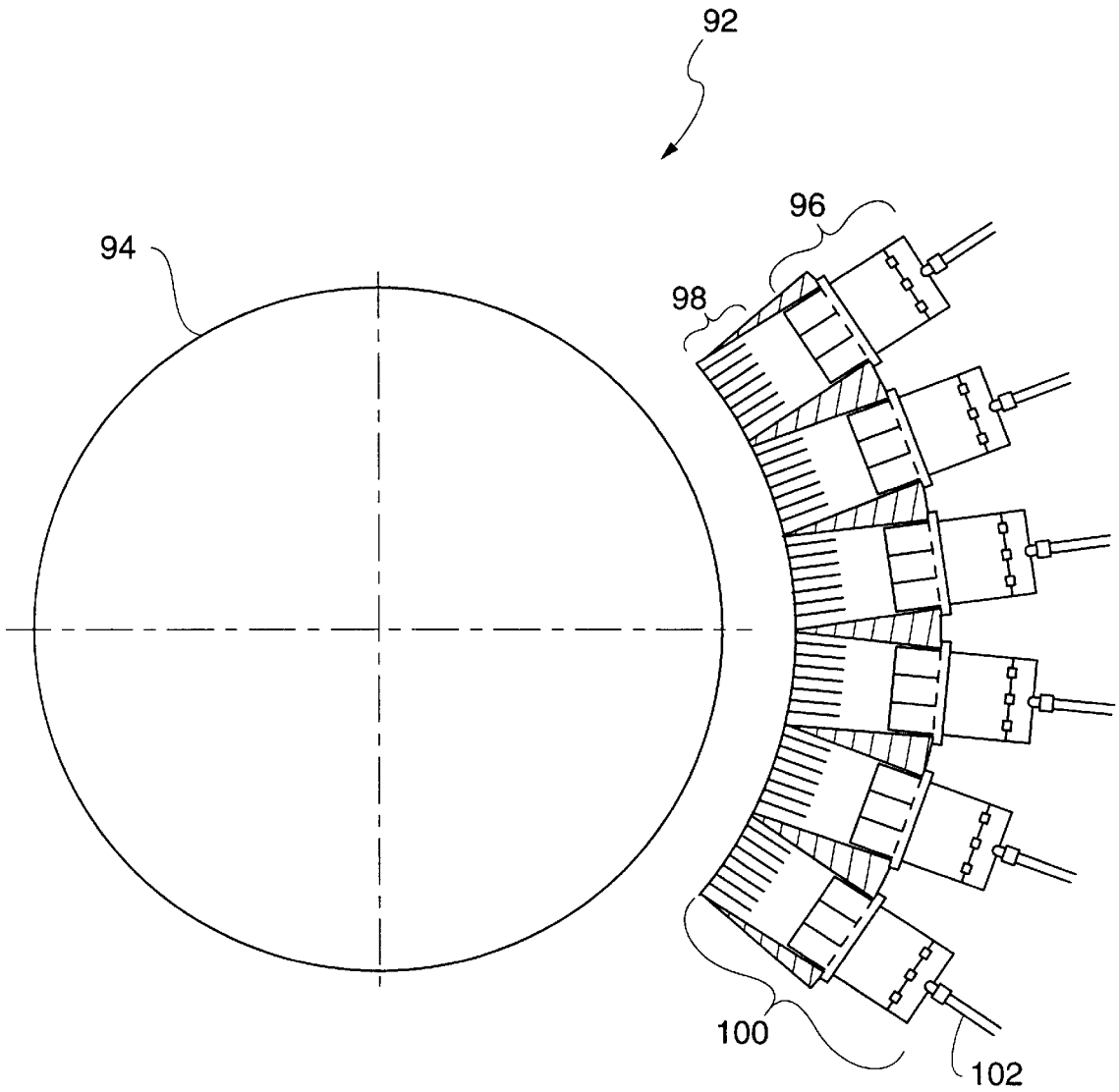
FIG. 5 is a side view illustrating another embodiment of the antenna system of the present invention.

FIG. 5 is a side view of an antenna system 92 in accordance with the present invention. The system 92 includes: a spherical lens 94, a plurality of phased array antennas 96, and a corresponding plurality of waveguide lenses 98. As illustrated in FIG. 5, the phased array antennas 96 and the waveguide lenses 98 are arranged in antenna/lens pairs 100 around the periphery of the spherical lens 94. Preferably, the antenna/lens pairs 100 are equally spaced around the periphery of the spherical lens 94 in fixed relation to one another. The pairs 100 may be arranged in a single line or in a two-dimensional array.

Each of the antenna/lens pairs 100 illustrated in FIG. 5, in conjunction with the spherical lens 94, is capable of producing an independently steerable secondary beam on an opposite side of the spherical lens 94. Therefore, the system of FIG. 5 is capable of producing multiple independently steerable beams simultaneously. The antenna/lens pairs 100 each include an input/output port 102 for channelling receive and transmit signals to and from internal processing circuitry (not shown). In transmit mode, each of the antenna/lens pairs 100 can receive an individually generated transmit signal from a separate signal generating means (not shown) or a single signal can be divided and delivered to each of the pairs 100. In a system using individually generated input signals, two or more different signal frequencies may be used. For example, every other pair 100 in the system 92 of FIG. 5 could be transmitting at a first frequency while the other pairs 100 in the system 92 are transmitting at a second frequency. By using dissimilar frequencies in adjacent pairs 100, interference caused by an overlap of adjacent transmit beams can be avoided. This idea can be extended by utilizing a unique frequency for each of the pairs in the system 92.

Figure 6:
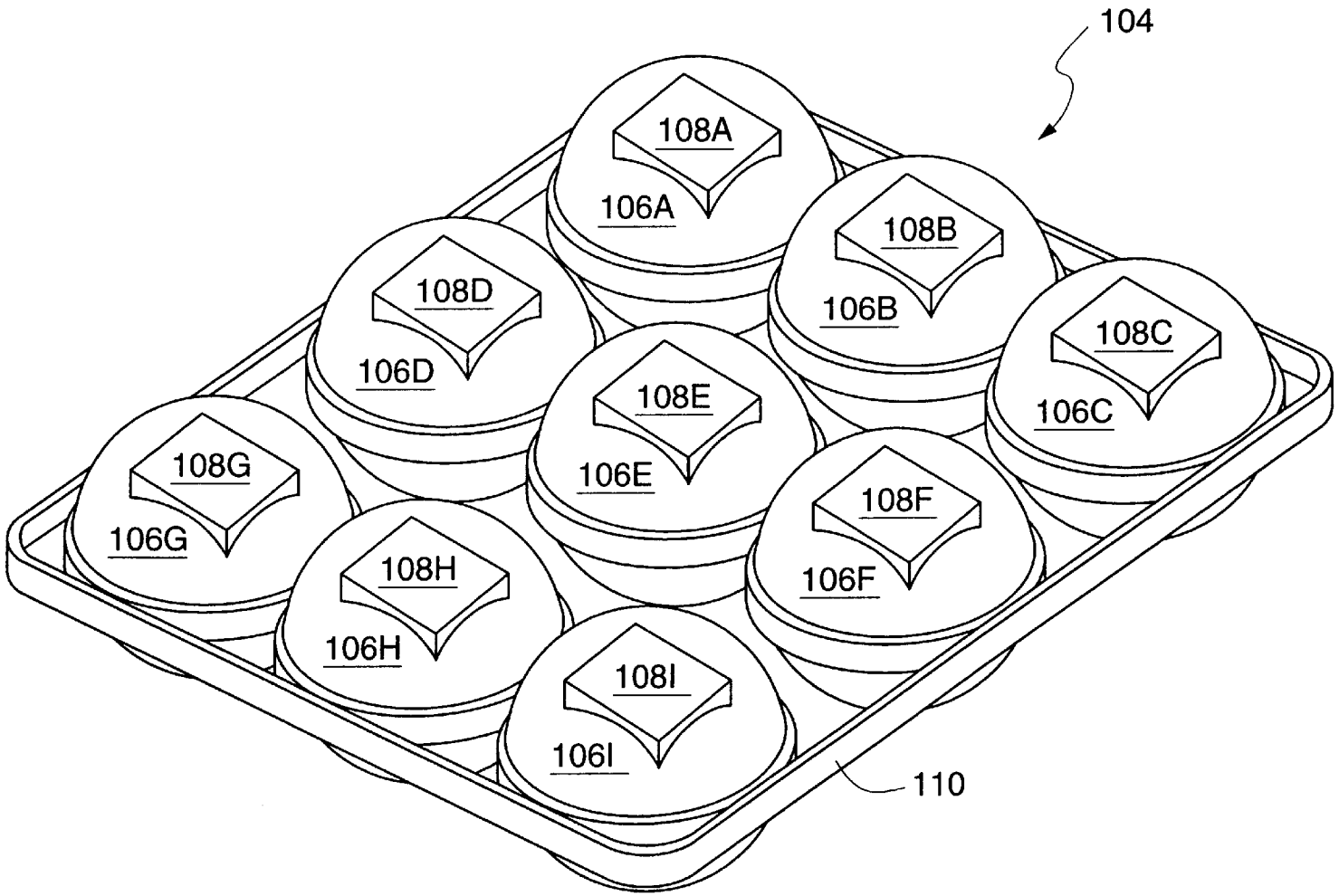
FIG. 6 is a perspective view illustrating yet another embodiment of the antenna system of the present invention.

FIG. 6 is a perspective view of an antenna system 104 in accordance with the present invention. The system 104 includes nine spherical lenses 106A–106I each having an associated feed unit 108A–108I. The spherical lenses 106A–106I are positioned in fixed relation to one another using a support structure 110. The spacing between adjacent lenses is chosen so as to prevent or reduce the illumination of one lens by the fields associated with an adjacent lens. Each feed unit 108 includes one or more phased array antennas (not shown). In addition, each phased array antenna within each feed unit 108 may have a focusing means (not shown) between it and a corresponding spherical lens 106.

Figure 7:
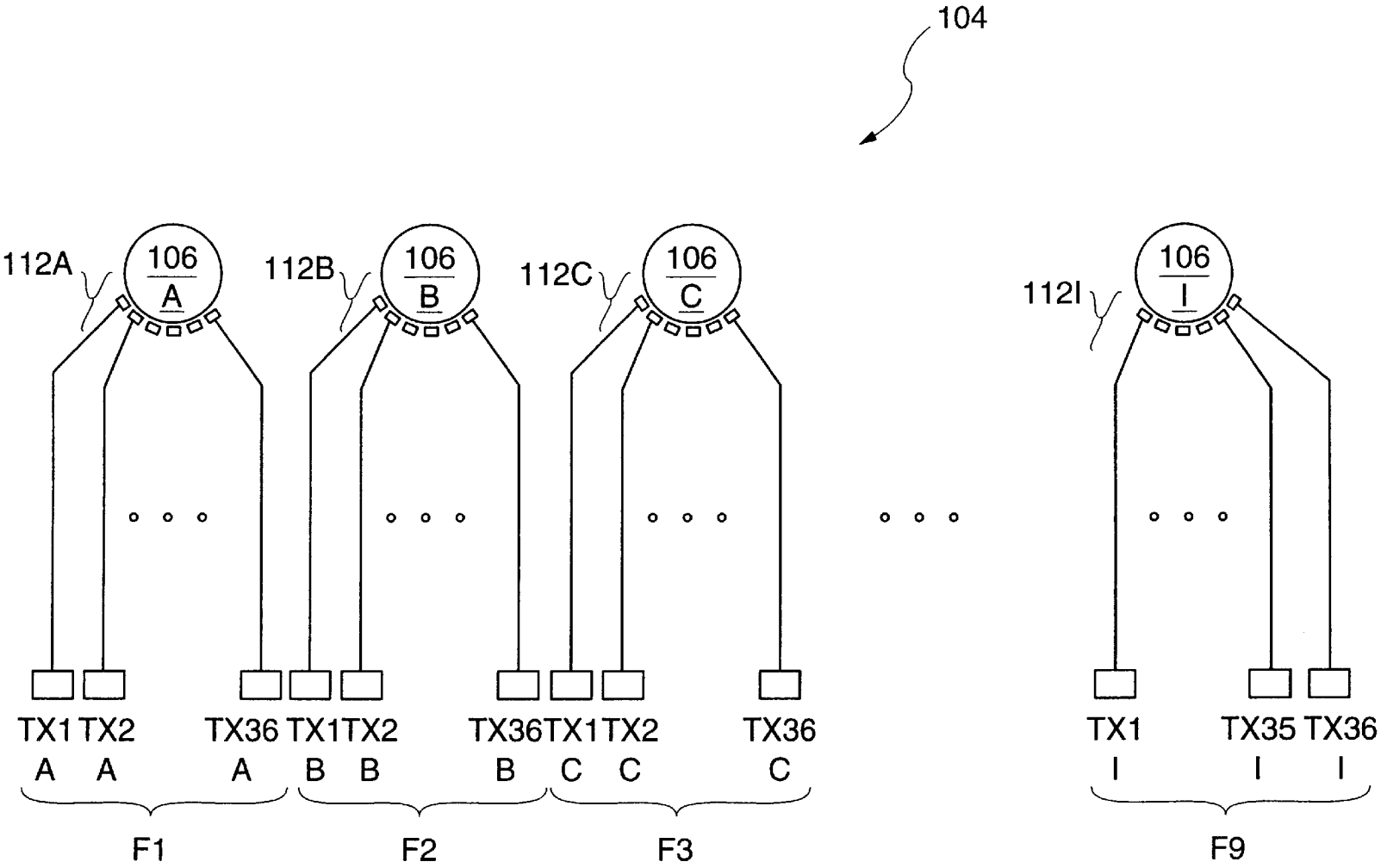
FIG. 7 is a schematic diagram illustrating a variation of the antenna system of FIG. 6.

FIG. 7 is a schematic diagram illustrating the system 104 of FIG. 6 wherein each feed unit 108A–108I includes a separate plurality of phased array antennas 112A–112I. Each plurality 112A–112I includes 36 antennas. These phased array antennas are each mounted around the periphery of a corresponding spherical lens 106 and may each have an associated waveguide lens. Each phased array antenna in each plurality 112 is driven by a separate transmitter means TX1–TX36. In the system 104 of FIG. 7, each spherical lens assembly is capable of producing 36 independently steerable beams simultaneously. The system 104, therefore, is capable of producing nine times as many, or 324, independently steerable beams simultaneously.

Figure 8:
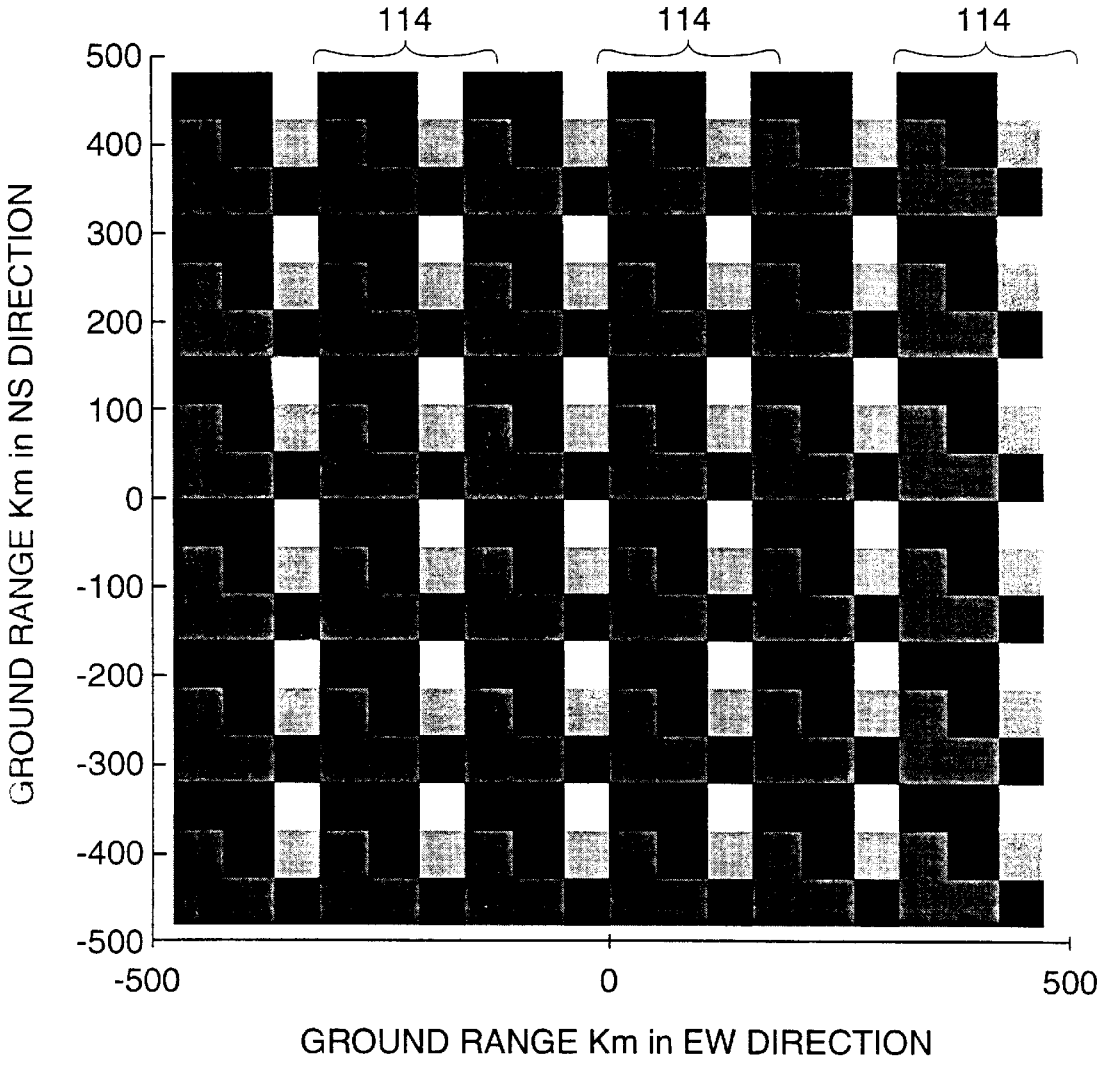
FIG. 8 is a ground coverage map illustrating a possible ground coverage scheme for the antenna system of FIG. 7.

FIG. 8 illustrates a possible ground coverage map for a satellite communications system utilizing the antenna system 104 of FIG. 7. The map represents an area on the earth's surface to which a particular satellite is to provide communications services. As illustrated, the map divides the area into 324 cells. Each cell, therefore, can be serviced by one of the beams from antenna system 104. Because the beams are each independently steerable, the direction of each beam may be continuously, periodically, or randomly adjusted to compensate for such things as satellite drift and pointing error.

Figure 9:
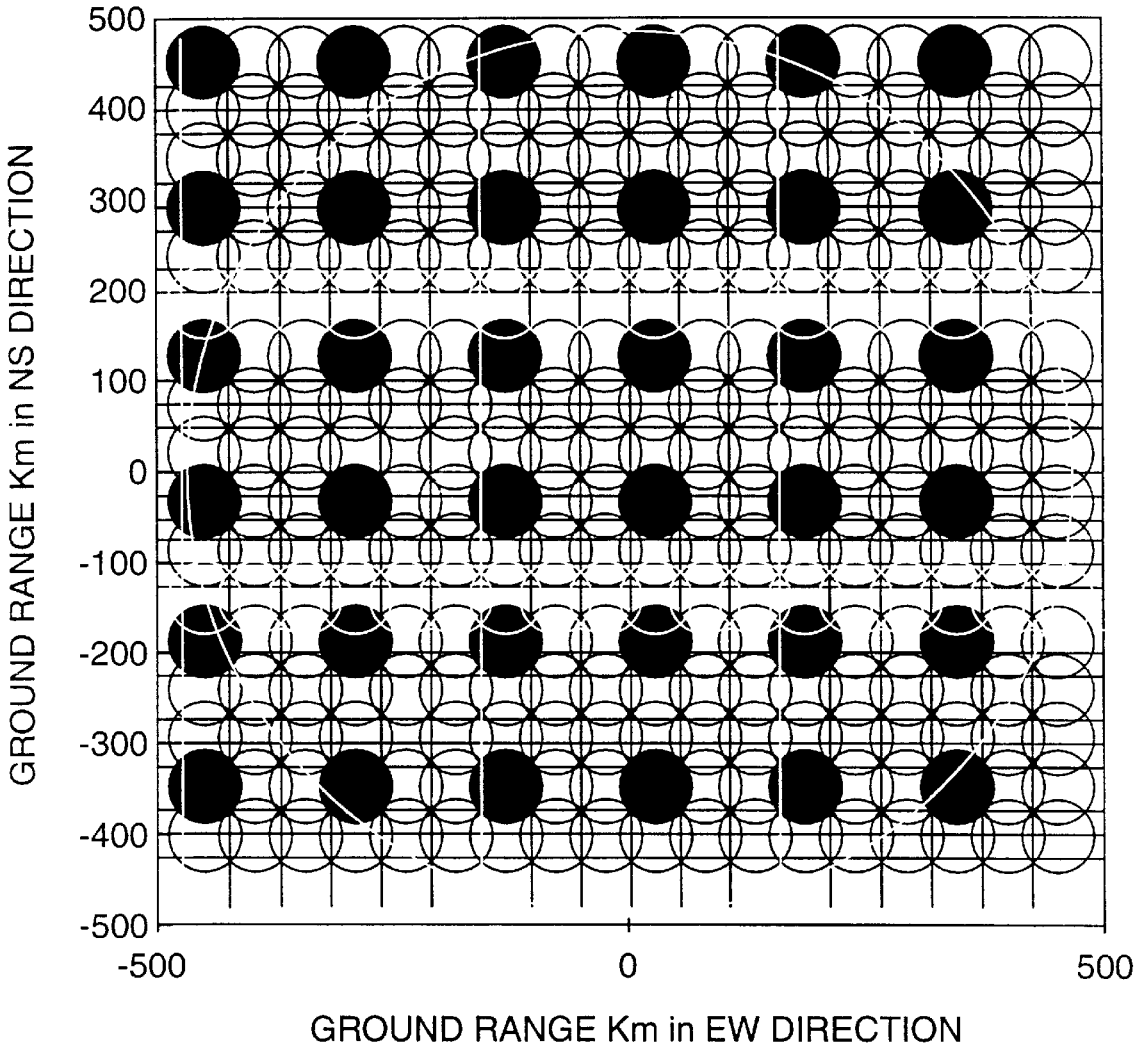
FIG. 9 is a ground coverage map illustrating the radiation footprint of a single spherical lens assembly in one embodiment of the present invention.

Because it is possible for adjacent beam footprints to overlap, interference between adjacent beams is possible. To reduce or eliminate possible interference problems, all adjacent cells in the coverage map of FIG. 8 may utilize different frequency ranges. For example, as illustrated in FIG. 7, each of the spherical lens assemblies in the system 104 can transmit and receive at a unique frequency (i.e., F1, F2, F3, etc.). Beams from each of the lenses 106A–106I may then be interspersed so that no two adjacent cells in the ground coverage map utilize the same frequency. One way of accomplishing this is by using supercells. As illustrated in FIG. 8, the cells of the ground coverage map may be divided into 9-cell supercells 114. Each supercell 114 includes one cell corresponding to each of the 9 spherical lenses 106A–106I. Because each of the 9 spherical lens assemblies is operating at a unique frequency, no two adjacent cells in the supercell utilize the same frequency. In addition, the supercells repeat throughout the entire ground coverage map so that no two adjacent cells in the entire map utilize the same frequency. The darkened circles in the map of FIG. 9 illustrate the radiation footprint required of a single spherical lens assembly to produce the supercell pattern of FIG. 8.

Although the present invention has been described in conjunction with certain preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A lens antenna having an electronically steerable beam, comprising:

a lens capable of collimating a beam focused on a focal surface adjacent to the lens;

at least one phased array antenna having a plurality of antenna elements arranged in an array pattern, wherein selected elements in said plurality of antenna elements have an electronically controllable phasing means associated with them for use in steering a primary beam associated with said at least one phased array antenna; and focusing means composed of at least a first material and located between said lens and said at least one phased array antenna for use in focusing said primary beam from said at least one phased array antenna on said focal surface of said lens to create a relatively high gain secondary beam on an opposite side of said lens, said focusing means having refractive properties in which said refractive properties are used to focus said primary beam on said focal surface of said lens and with said refractive properties being based on at least said first material;

wherein said secondary beam may be steered by adjusting said electronically-controllable phasing means associated with said phased array antenna.

2. The antenna as claimed in claim 1, wherein:

said primary beam is a transmit beam.

3. The antenna as claimed in claim 2, further comprising:

transmitter means associated with selected elements in said plurality of antenna elements for driving each of said selected elements with a signal having a predetermined amplitude and phase to create said primary transmit beam, wherein said transmitter means includes said electronically controllable phasing means.

4. The antenna as claimed in claim 1, wherein:

said primary beam is a receive beam.

5. The antenna as claimed in claim 4, further comprising:

receiver means associated with selected elements in said plurality of antenna elements for receiving a signal from each of said selected elements and for processing said signal based on said primary receive beam, wherein said receiver means includes said electronically controllable phasing means.

6. The antenna as claimed in claim 4, wherein:

said at least one phased array antenna includes a plurality of phased array antennas for creating multiple secondary beams using a single spherical lens.

7. The antenna as claimed in claim 6, wherein:

said multiple secondary beams are created simultaneously.

8. The antenna as claimed in claim 6, wherein:

said multiple secondary beams are each independently steerable.

9. The antenna as claimed in claim 1, wherein:

said lens comprises a spherical lens.

10. The antenna as claimed in claim 9, wherein:

said spherical lens includes one of the following: a Luneberg lens, a constant-K lens, and a spherical shell lens.

11. The antenna as claimed in claim 1, wherein:

said focusing means focuses said primary transmit beam on said focal surface to simulate a single point source on said focal surface.

12. The antenna as claimed in claim 1, wherein:

said refractive properties are based on a plurality of dimensions of said focusing means.

13. The antenna as claimed in claim 1, wherein:

said refractive properties are based on a shape of said focusing means.

14. The antenna as claimed in claim 1, wherein:

said focusing means is different from conductive lines connected to said lens.

15. A lens antenna having an electronically steerable beam, comprising:

a lens capable of collimating a beam focused on a focal surface adjacent to the lens;

at least one phased array antenna having a plurality of antenna elements arranged in an array pattern, wherein selected elements in said plurality of antenna elements have an electronically controllable phasing means associated with them for use in steering a primary beam associated with said at least one phased array antenna; and focusing means located between said lens and said at least one phased array antenna for use in focusing said primary beam from said at least one phased array antenna on said focal surface of said lens to create a relatively high gain secondary beam on an opposite side of said lens, said focusing means including a waveguide lens;

wherein said secondary beam may be steered by adjusting said electronically-controllable phasing means associated with said phased array antenna.

16. The antenna as claimed in claim 15, wherein:

said waveguide lens includes a plurality of waveguide sections.

17. The antenna as claimed in claim 16, wherein:

said plurality of waveguide sections are arranged in an array pattern large enough to capture a substantial portion of said primary beam associated with said at least one phased array antenna.

18. A lens antenna having an electronically steerable beam, comprising:

a lens capable of collimating a beam focused on a focal surface adjacent to the lens;

at least one phased array antenna having a plurality of antenna elements arranged in an array pattern, wherein selected elements in said plurality of antenna elements have an electronically-controllable phasing means associated with them for use in steering a primary beam associated with said at least one phased array antenna; and focusing means located between said lens and said at least one phased array antenna for use in focusing said primary beam from said at least one phased array antenna on said focal surface of said lens to create a relatively high gain secondary beam on an opposite side of said lens, said focusing means including a dielectric lens;

wherein said secondary beam may be steered by adjusting said electronically controllable phasing means associated with said phased array antenna.

19. A multiple beam antenna system, comprising:

a plurality of spherical lenses, each said lens capable of collimating a beam focused on a focal surface adjacent to each said lens;

at least one phased array antenna associated with each of said spherical lenses for creating an electronically-steerable primary beam which is coupled to said spherical lens to produce a relatively high gain secondary beam on an opposite side of said spherical lens; and focusing means composed of at least a first material and located between said at least one phased array antenna and an associated spherical lens of said plurality of spherical lenses for focusing an electronically steerable primary beam on said focal surface of said associated spherical lens, said focusing means having refractive properties in which said refractive properties are used to focus said primary beam on said focal surface of said associated spherical lens and with said refractive properties being based on at least said first material of said focusing means.

20. The antenna as claimed in claim 19, wherein:

said electronically steerable primary beam is a transmit beam.

21. The antenna as claimed in claim 20, wherein:

each plurality of phased array antennas includes an equal number of phased array antennas.

22. The antenna as claimed in claim 20, wherein:

said system is adapted for use in a satellite communications system.

23. The antenna as claimed in claim 22, wherein:

said system is capable of producing a plurality of secondary beams, wherein said plurality of secondary beams is capable of simultaneously covering a predetermined portion of earth's surface.

24. The antenna as claimed in claim 19, wherein:

said electronically steerable primary beam is a receive beam.

25. The antenna as claimed in claim 19, wherein:

said plurality of spherical lenses are arranged in fixed relation to one another.

26. The antenna as claimed in claim 19, wherein:

said at least one phased array antenna includes a plurality of phased array antennas arranged in fixed relation to one another.

27. A lens antenna having an electronically steerable beam, comprising:

a lens capable of collimating a beam focused on a focal surface adjacent to the lens;

at least one phased array antenna having a plurality of antenna elements arranged in an array pattern, wherein selected elements in said plurality of antenna elements have an electronically controllable phasing means associated with them for use in steering a primary beam associated with said at least one phased array antenna; and focusing means located between said lens and said at least one phased array antenna for use in focusing said primary beam from said at least one phased array antenna on said focal surface of said lens to create a relatively high gain secondary beam on an opposite side of said lens, wherein a majority of said primary beam is coupled from said focusing means to said lens using a communication medium different from conductive lines;

wherein said secondary beam may be steered by adjusting said electronically controllable phasing means associated with said phased array antenna.

28. The antenna as claimed in claim 27, wherein:

said focusing means includes a first material and has refractive properties and in which said refractive properties are used to focus at least said majority of said primary beam on said focal surface based on at least said first material.

29. The antenna as claimed in claim 27, wherein:

said communication medium includes unoccupied space.

* * * * *